US008033611B2

(12) United States Patent
Chen

(10) Patent No.: US 8,033,611 B2
(45) Date of Patent: Oct. 11, 2011

(54) BENCH

(75) Inventor: Yun-Lu Chen, Taipei (TW)

(73) Assignee: Danny Plastics Co. Ltd., Shin-Yuan Hsiang, Ping-Tung (TW)

( * ) Notice: Subject to any disclaimer, the term of this patent is extended or adjusted under 35 U.S.C. 154(b) by 149 days.

(21) Appl. No.: 12/569,916

(22) Filed: Sep. 30, 2009

(65) Prior Publication Data

US 2011/0074200 A1 Mar. 31, 2011

(51) Int. Cl.

| | |
|---|---|
| ***A47C 5/12*** | (2006.01) |
| ***A47C 7/02*** | (2006.01) |
| ***A47C 7/16*** | (2006.01) |
| ***A47C 7/36*** | (2006.01) |
| ***A47C 7/54*** | (2006.01) |

(52) U.S. Cl. ..... 297/440.1; 297/440.14; 297/440.2; 297/440.22; 297/446.1; 297/446.2; 297/447.1; 297/447.2; 297/447.3; 297/448.1; 297/451.11; 297/451.12; 297/411.44

(58) Field of Classification Search ..... 297/411.44, 297/440.1, 440.14, 440.2, 440.22, 446.1, 297/446.2, 447.1, 447.2, 447.3, 447.4, 448.1, 297/451.11, 451.12

See application file for complete search history.

(56) References Cited

U.S. PATENT DOCUMENTS

| | | | | |
|---|---|---|---|---|
| 151,873 | A * | 6/1874 | Grant | 297/440.2 |
| 861,454 | A * | 7/1907 | Garrison | 297/446.1 |
| 1,542,770 | A * | 6/1925 | Hess | 297/440.1 |
| 2,320,595 | A * | 6/1943 | Henkel et al. | 297/447.1 X |
| 2,374,837 | A * | 5/1945 | Rush | 297/447.1 |
| D165,952 | S * | 2/1952 | Weatherly | 297/411.44 X |
| 3,213,570 | A * | 10/1965 | Abramson, Jr. | 297/451.11 X |
| 3,482,874 | A * | 12/1969 | Henebry et al. | 297/440.22 X |
| 3,554,142 | A * | 1/1971 | Sorenson et al. | 108/157.13 |
| 3,748,012 | A * | 7/1973 | Abelman | 297/440.1 X |
| 3,751,109 | A * | 8/1973 | Dufton | 297/440.22 X |
| 3,907,363 | A * | 9/1975 | Baker et al. | 297/440.2 X |
| 4,002,369 | A * | 1/1977 | Jennings | 297/451.11 |
| 4,073,539 | A * | 2/1978 | Caruso | 297/411.44 X |
| 4,519,651 | A * | 5/1985 | Whitwam | 297/411.44 X |
| 5,102,196 | A * | 4/1992 | Kaneda et al. | 297/411.44 X |
| D351,301 | S * | 10/1994 | Adamson | D6/501 |
| 5,427,437 | A * | 6/1995 | Lacasse | 297/446.1 X |
| 5,653,507 | A * | 8/1997 | Moore | 297/440.14 |
| 5,655,816 | A * | 8/1997 | Magnuson et al. | 297/440.22 X |
| 5,690,388 | A * | 11/1997 | Saiger | 297/447.2 |
| 5,810,438 | A * | 9/1998 | Newhouse | 297/411.44 X |
| 5,839,787 | A * | 11/1998 | Magnuson et al. | 297/440.22 X |
| 6,367,874 | B2 * | 4/2002 | Casini | 297/440.14 X |
| 6,460,924 | B1 * | 10/2002 | Josephs | 297/440.1 X |
| 6,523,900 | B1 * | 2/2003 | Conner et al. | 297/440.1 X |
| 7,275,788 | B2 * | 10/2007 | Dettmann et al. | 297/448.1 X |
| 7,918,509 | B1 * | 4/2011 | Chen | 297/440.22 |

FOREIGN PATENT DOCUMENTS

| | | | | |
|---|---|---|---|---|
| EP | 111679 | A2 * | 6/1984 | 297/446.1 |

* cited by examiner

*Primary Examiner* — Rodney B White

(74) *Attorney, Agent, or Firm* — Alan Kamrath; Kamrath & Associates PA

(57) ABSTRACT

A bench includes at least two feet, a plurality of seat plates, a back plate, and an armrest. A back portion is extended from an upper edge of each foot, and a cushion portion is formed at a bottom of the back portion. The seat plates and the back plates are fixed to the cushion portions and the back portions of the feet by bolts, and the armrests are fixed to the back plate and two lateral sides of the seat plate by bolts so as to form a strong and fine bench.

5 Claims, 8 Drawing Sheets

BENCH

FIELD OF THE INVENTION

The present invention relates to a bench and, in particular, to a bench assembled by bolts and several components made of Polypropylene (PP) and Polyethylene (PE). The strong and fine bench is suitable for yards, parks, and the outdoors.

DESCRIPTION OF THE PRIOR ART

Benches are an important element of leisure ambiance providing comfortable relaxation in a public park, a square or a private yard. For the consideration of outdoor usage, metals are the most common material since they resist corruption, are heatproof, and are easy to clean. The prior bench has a welded, molded or forged frame body with metal bars as a seat, back, or armrests of the bench. However, the cold appearance of such bench can not fit the surroundings, especially in a park or yard with nature, landscape and plants. Moreover, manufacture is complicated and can not be done by the consumer. Also, the size and weight of the product result in difficulty of transport and assembling.

Furthermore, it is disturbing that most users have to purchase the whole assembly but are unable to transport the assembly by an ordinary vehicle. An easy handling bench is truly a demand for common consumers nowadays.

SUMMARY OF THE PRESENT INVENTION

Accordingly, the primary object of the present invention is to provide a strong and fine bench assembled by bolts and several components made in advance.

To achieve the above object, the present invention provides a bench including at least two feet, a plurality of seat plates, a back plate, and two armrests, each made of Polypropylene (PP) and Polyethylene (PE) and formed separately. Each foot is substantially h-shaped, and enhanced sheets are extended from a peripheral surface of each foot. A back portion is extended from an upper edge of the foot. A cushion portion is formed to a bottom of the back portion. A plurality of through holes are formed in the back portion and the cushion portion. The seat plate is a rectangular plate, and a plurality of protruding blocks is formed on a bottom surface thereof. A bolt block is embedded in each protruding block. The plurality of bolt blocks matches the plurality of through holes of the cushion portion of the foot. The back plate is a rectangular plate. The armrest is a frame body for resting a human's arm, and screw holes for bolts are formed in a rear side and a bottom side thereof. The seat plates and the back plates are fixed to the cushion portions and the back portions of the feet by fastening bolts through the plurality of through holes. The armrests will be fixed to the back plate and two lateral sides of the seat plate by bolts.

DETAILED DESCRIPTION OF THE INVENTION

In order that those skilled in the art can further understand the present invention, a detailed description will be provided. However, these descriptions and the appended drawings are only used to cause those skilled in the art to understand the objects, features, and characteristics of the present invention, but not to be used to confine the scope and spirit of the present invention defined in the appended claims.

Figure 1:
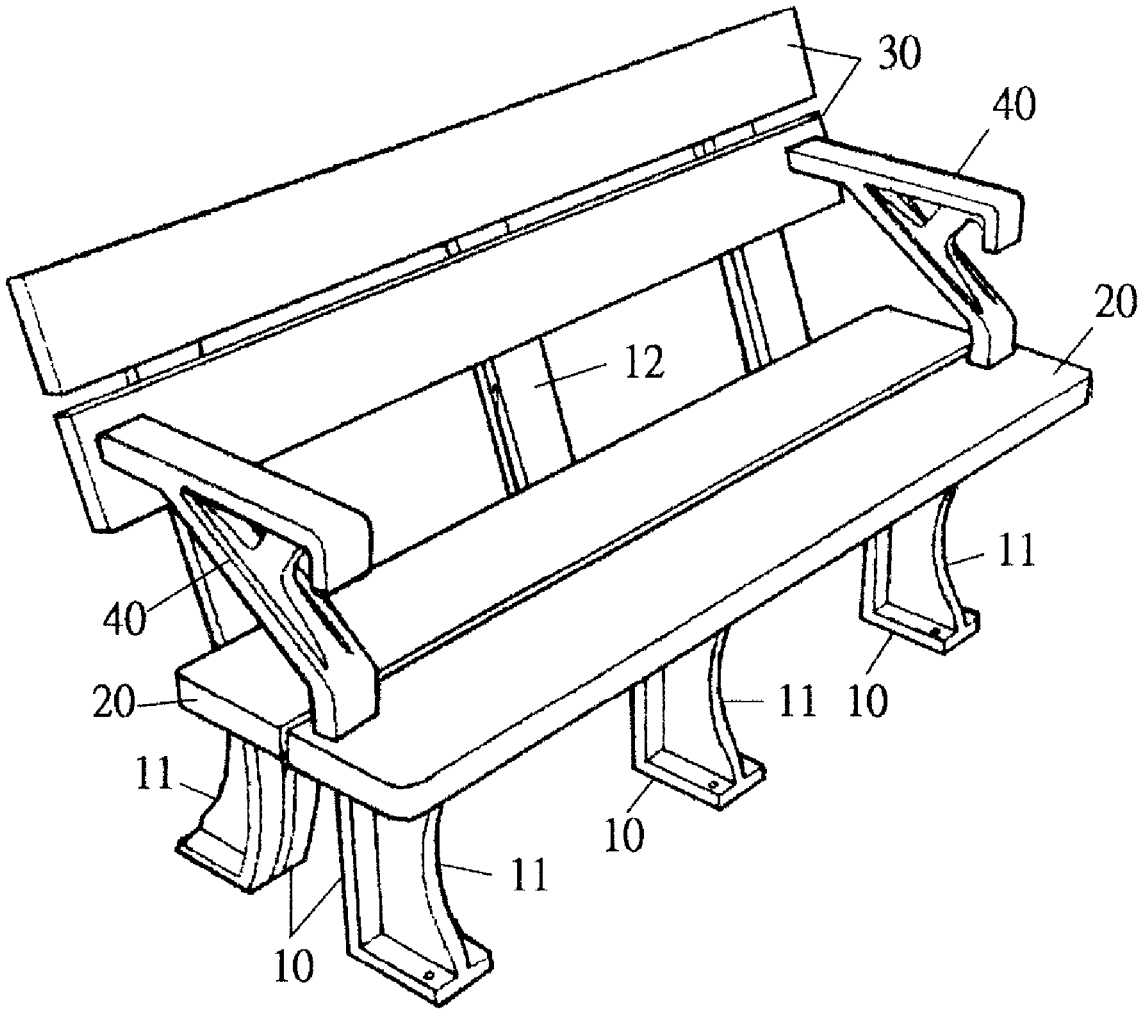
FIG. 1 is a structural view showing an assembly of the present invention.

Referring to FIG. 1, the present invention includes a plurality of feet 10, a seat plate 20, a back plate 30, and two armrests 40. The feet 10, the seat plate 20, the back plate 30, and the armrest 40 are made of Polypropylene (PP) and Polyethylene (PE) and are formed separately.

Figure 2:
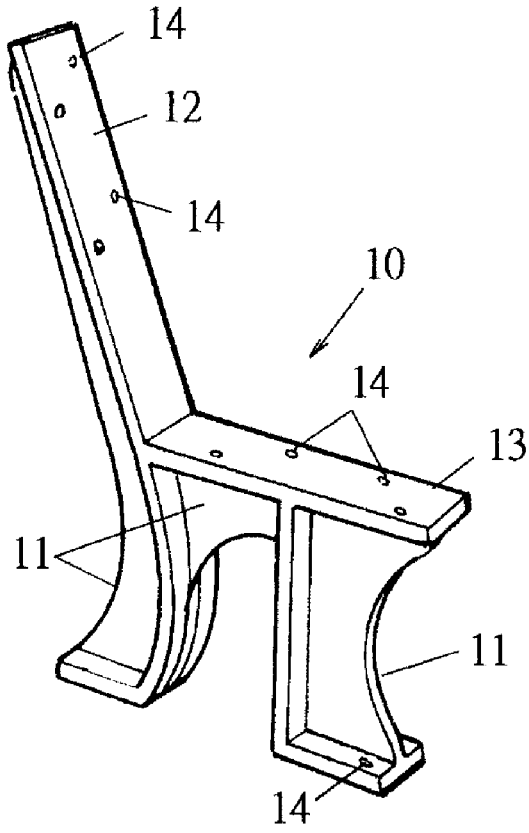
FIG. 2 is a structural view showing a foot of the present invention.

Each foot 10 is substantially h-shaped as shown in FIG. 2, and enhanced sheets 11 are extended from a lower and a back side of the foot 10 to strengthen the foot 10. A back portion 12 is extended from an upper edge of the foot 10. A cushion portion 13 is formed at a bottom of the back portion 12. The cushion portion 13 is downward inclined towards the back portion with an angle between 2 to 8 degrees. A plurality of through holes 14 are formed in a bottom of the foot 10, the back portion 12 and the cushion portion 13.

Figure 3:
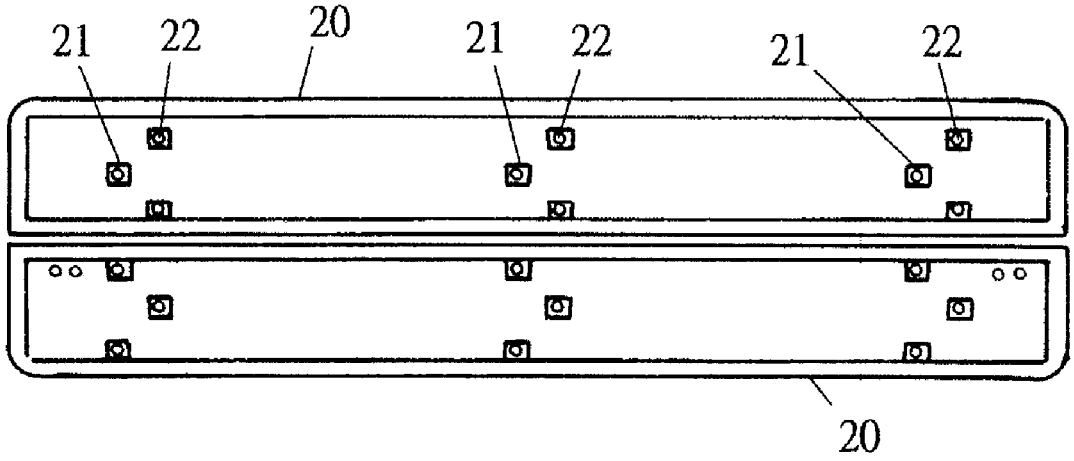
FIG. 3 is a plan view showing a seat plate of the present invention.

The seat plate 20 is a rectangular plate as shown in FIG. 3. A top surface is a plane, and a plurality of protruding blocks 21 is formed on a bottom surface thereof. A bolt block 22 is embedded in each protruding block 21. The plurality of bolt blocks 22 matches the plurality of through holes 14 of the cushion portion 13 of the foot 10.

Figure 4:
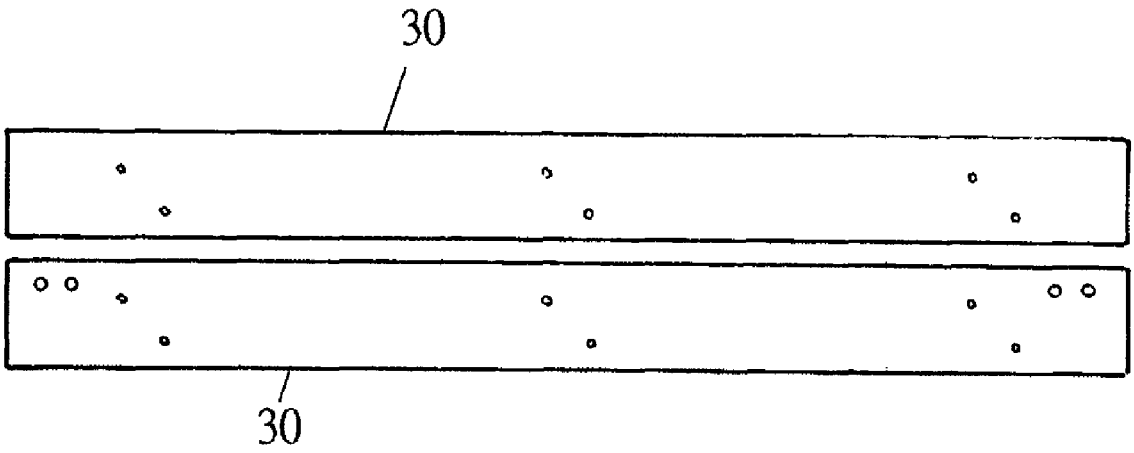
FIG. 4 is a plan view showing a back plate of the present invention.

The back plate 30 is a rectangular plate as shown in FIG. 4.

Figure 5:
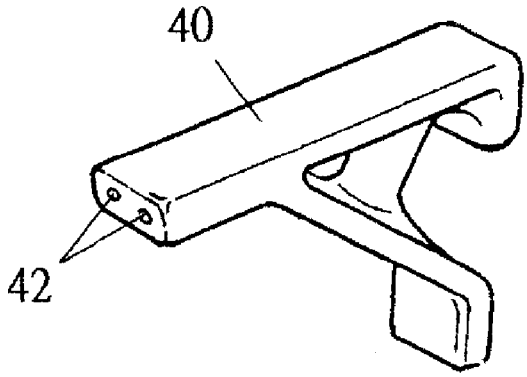
FIG. 5 is a structural view showing an armrest of the present invention.

The armrest 40 is a frame body for resting a human arm, screws 42 for bolts 41 are formed in a rear side and a bottom side of the armrest 40 as shown in FIG. 5.

The armrest 40 is a frame body for resting a human arm, screw holes 42 for bolts 41 are formed in a rear side and a bottom side of the armrest 40 as shown in FIG. 5.

Figure 6:
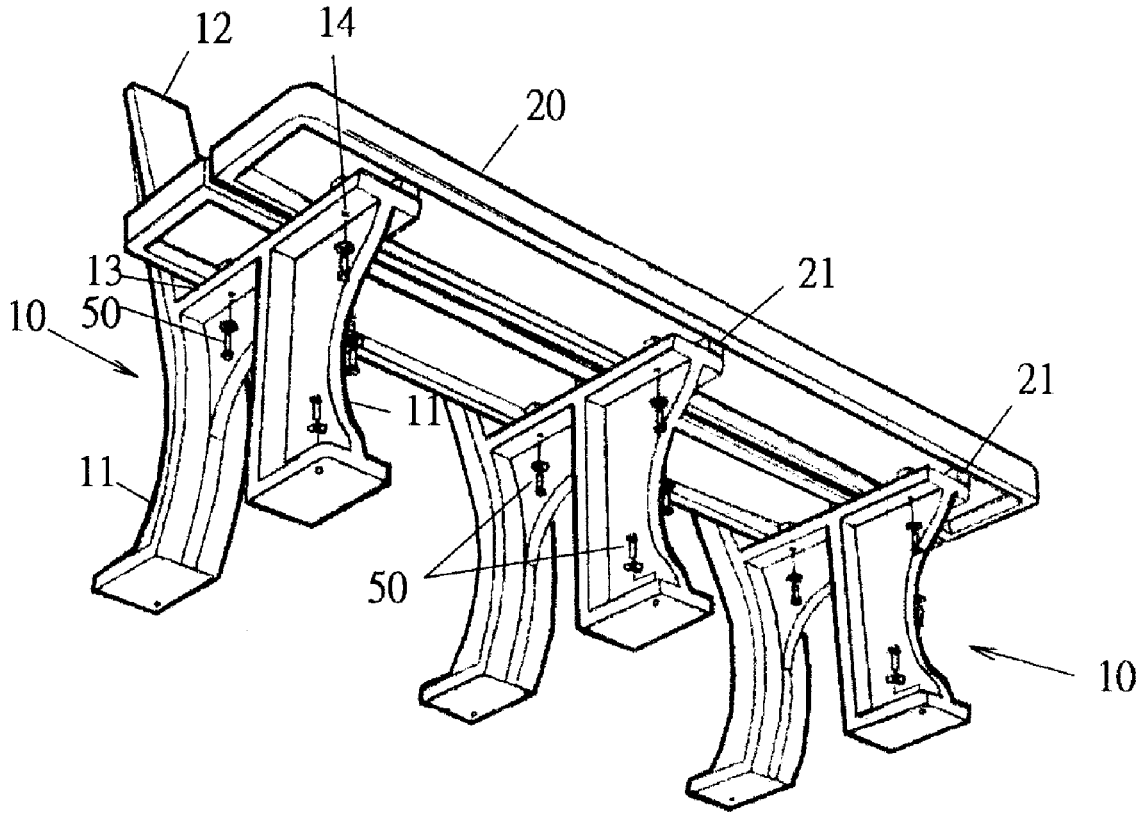
FIG. 6 is an assembly view showing the assembly of the present invention.
Figure 7:
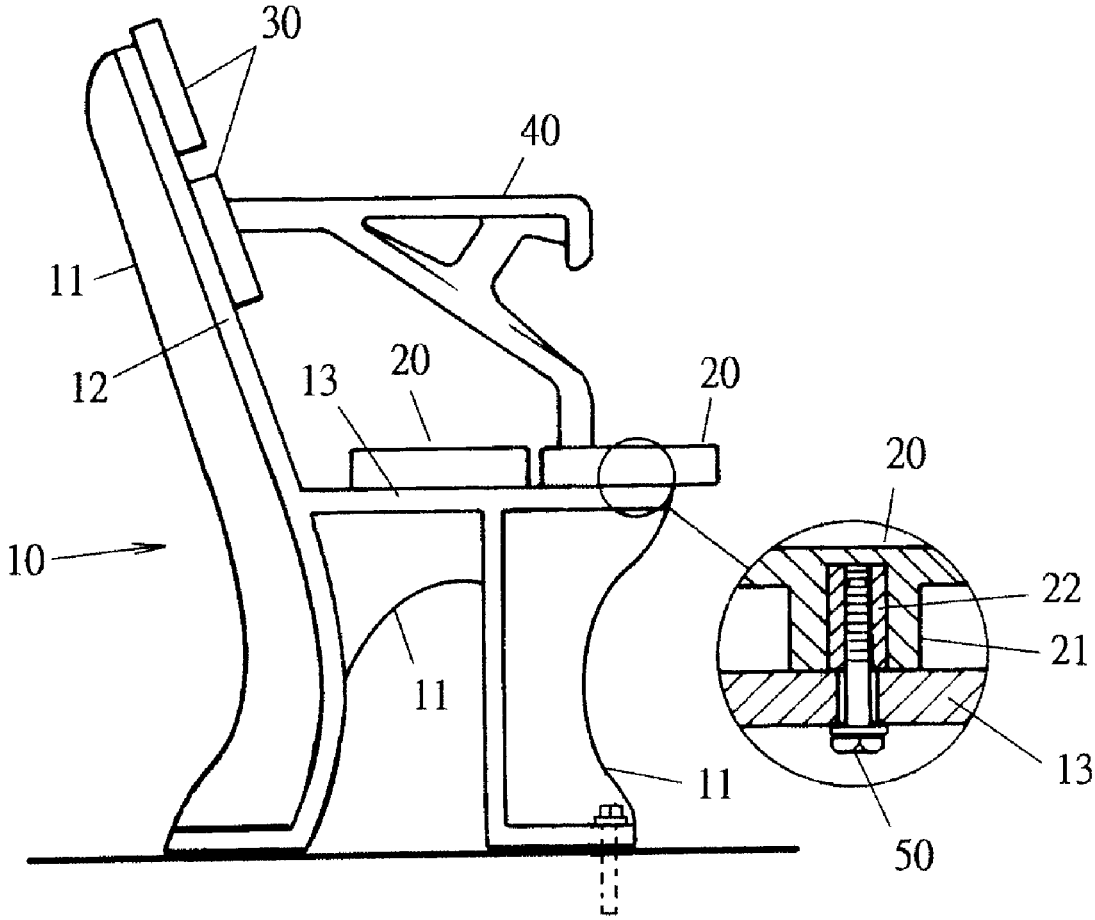
FIG. 7 is a side view with a partially prospective view of the present invention.
Figure 8:
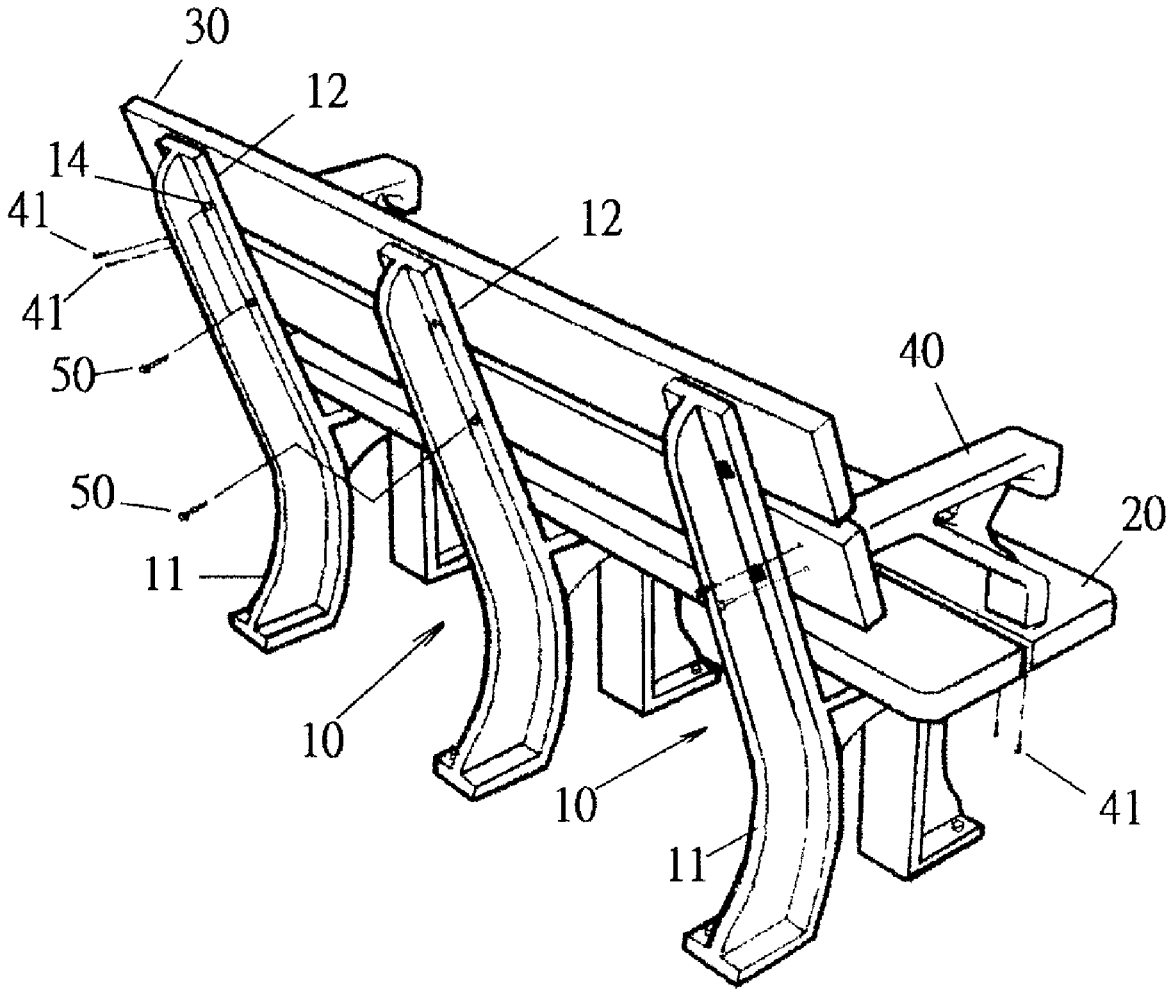
FIG. 8 is an assembly view showing the assembling of the back plate and the armrest.

With reference to FIGS. 6 and 7, the seat plates 20 are fixed above the cushion portions 13 of the feet 10 by fastening the bolt blocks 22 of the seat plates 20 through the corresponding through holes 14 of the feet 10 with bolts 50 so that the seat plates 20 can be sat upon by hips of a human. With reference to FIG. 8, the back plates 30 are fixed to the back portions 12 of the feet 10 by fastening the back plates 30 through the through holes 14 of the back portion 12 with bolts 50 so that the back plates 30 can be leaned against by the human's back. The armrests 40 are fixed to the back plate 30 with the rear sides thereof and to the seat plate 20 with the bottom sides thereof by fastening the bolts 41 to the screw holes 42 of two lateral sides of the seat plate 20 for resting the human's arm thereon. Moreover, the feet 10 can be fixed to the floor by fastening the bolts 50 through the bottom through holes 14 of the feet 10.

Figure 9:
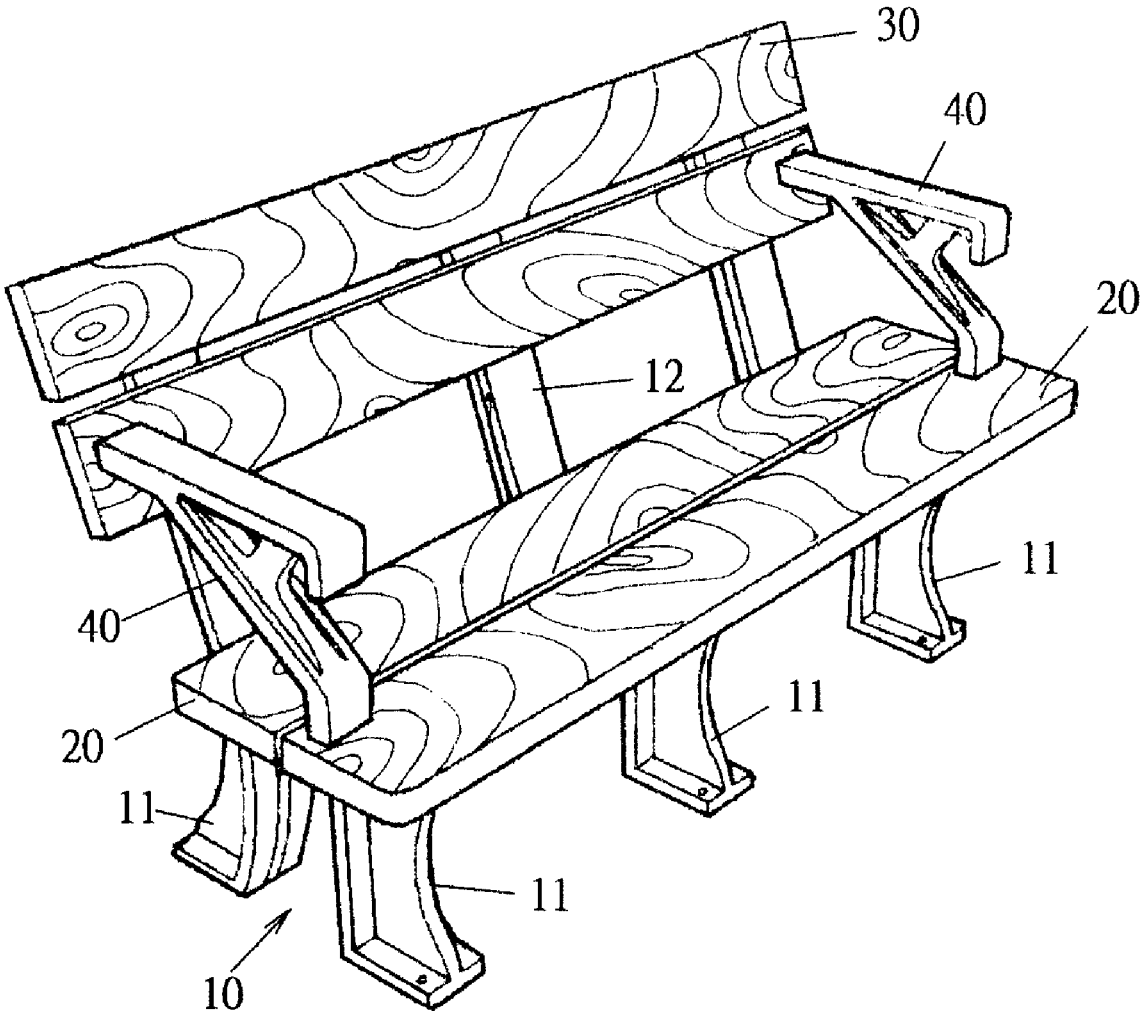
FIG. 9 is a schematic view showing the present invention with a grain of log.
Figure 10:
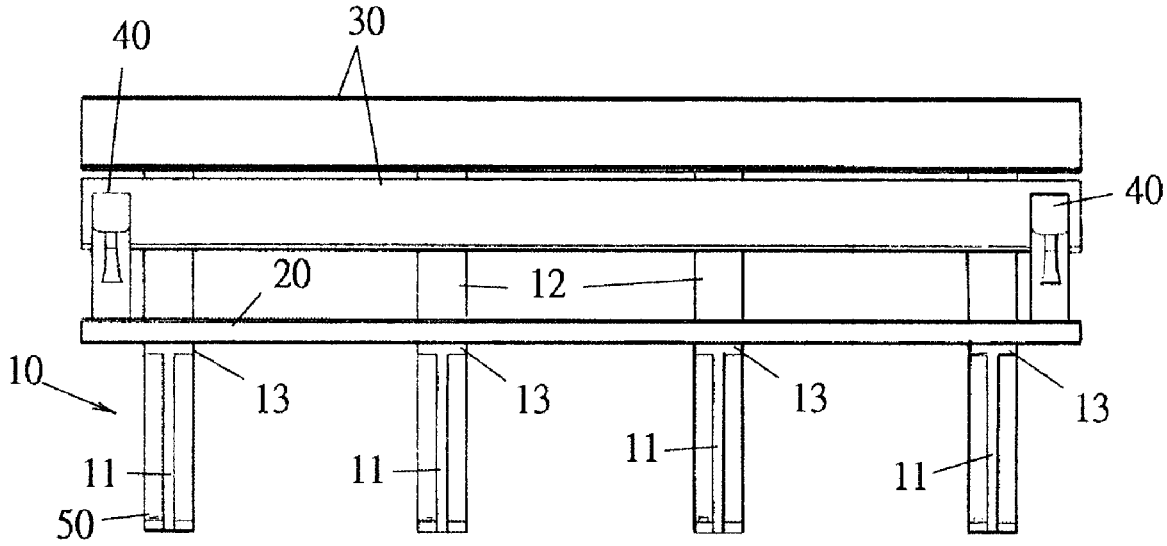
FIG. 10 is a plan view showing an extended bench of the present invention

Accordingly, the components of the present invention are made of Polypropylene (PP) and Polyethylene (PE) so that the color and grain are selectable. For example, the seat plate 20 and the back plate 30 can be made in brown with a wood grain so as to have an approximate appearance of logs as shown in FIG. 9. Furthermore, the bench shown in FIGS. 3 to 5 is assembled by two seat plates 20 and three feet 10. Similarly, in FIG. 10, four feet 10 (or more than four) are engaged to the extended seat plates 20 so that the bench is longer and stronger.

Therefore, the bench of the present invention has the following advantages.

1. The seat plate 20 is fixed to feet 10. The substantially h-shaped feet 10 and the enhanced sheets 11 formed to the feet 10 provide a stronger and stable support.

2. Each foot 10 and each seat plate 20 are formed flat so that they are easy to be packed and stored. It is also easy to assemble for any user by fastening the seat plates 20, the back plates 30, and the armrests 40 to the feet 10 with bolts.

3. The high polymer material of the feet 10 and seat plates 20 is strong, anti-corrupt, high and low temperature and weather proof, and also recyclable, which is contributive to the environment. Moreover, with a proper color and grain of the bench such as a brown log grain, a better appearance matching the surroundings is provided.

With the present invention thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. A bench comprising at least two feet, a plurality of seat plates, a back plate, and two armrests each made of Polypropylene (PP) and Polyethylene (PE) and formed separately; wherein each foot is substantially "h" shaped and includes a back portion, a cushion portion integrally formed at a bottom of the back portion and first and second legs of a substantially "L" shape extending downwardly from the cushion portion; wherein the first and second legs each include a vertical portion and a horizontal portion for being supported on a support surface, with the vertical portion of the first leg being integrally formed coextensive with the bottom of the back portion, with the horizontal portion of the first leg and the cushion portion extending in opposite directions, with a first enhanced sheet integrally extending from the back portion and the vertical and horizontal portions of the first leg, with the first enhanced sheet and the back portion and the vertical portion of the first leg being substantially "T" shaped in cross section; wherein the cushion portion has a free end opposite to the back portion; wherein the vertical portion of the second leg is integrally formed with the cushion portion intermediate the free end and the back portion; wherein a second enhanced sheet integrally extends from the cushion portion and between the vertical portions of the first and second legs with the second enhanced sheet and the cushion portion being substantially "T" shaped in cross section; wherein a third enhanced sheet integrally extends from the vertical portion of the second leg and between the horizontal portion of the second leg and the cushion portion; wherein the vertical portion of the second leg and the third enhanced sheet is substantially "T" shaped in cross section; wherein the horizontal portions of the first and second legs extend in opposite directions from the vertical portions; wherein a plurality of through holes are formed in each back portion and in each cushion portion on opposite sides of the first, second, and third enhanced sheets; wherein each seat plate is a rectangular plate, with a plurality of protruding blocks formed on a bottom surface of the rectangular plate; a bolt block is embedded in each protruding block; wherein the bolt blocks of the plurality of protruding blocks matches the plurality of through holes of the cushion portion of each foot; wherein the back plate is a rectangular plate; wherein each armrest is a frame body for resting a human's arm, wherein screw holes for bolts are formed in a rear side and a bottom side of each armrest; and the plurality of seat plates and the back plates are fixed to the cushion portions and the back portions of the at least two feet by fastening bolts through the plurality of through holes; wherein the armrests are fixed to the back plate and to two lateral sides of one of the plurality of seat plates by bolts.

2. The bench of claim 1 wherein each armrest comprises an arm portion of a substantially "L" shape and including a rest portion having the rear side fixed to the back plate and a downturned portion opposite to the rear side; wherein each armrest further comprises a support including a first portion and a second portion extending at an obtuse angle to the first portion, with the first portion integrally extending from the rest portion intermediate the rear side and the downturned portion, with the second portion including the bottom side fixed to the one of the plurality of seat plates.

3. The bench of claim 2 wherein each armrest includes a brace integrally extending generally perpendicular to the first portion of the support and integrally extending from the rest and downturned portions.

4. The bench of claim 3 wherein through holes are found in the horizontal portion of the second leg outwardly of the third enhanced sheet.

5. The bench of claim 4 wherein the cushion portion is downwardly inclined towards the back portion with an angle between 2 to 8 degrees.

* * * * *